United States Patent [19]

Kistner et al.

[11] 4,096,800

[45] Jun. 27, 1978

[54] DETENT DEVICE FOR A KEY SHAFT OF A PRINTING MECHANISM

[75] Inventors: Heinz Kistner, Neckarsteinach; Heinrich Volk, Beerfelden, both of Germany

[73] Assignee: Meto International GmbH, Hirschhorn, Germany

[21] Appl. No.: 780,952

[22] Filed: Mar. 24, 1977

Related U.S. Application Data

[63] Continuation of Ser. No. 605,783, Aug. 18, 1975, abandoned.

[30] Foreign Application Priority Data

Aug. 17, 1974 Germany ..... 2439523

[51] Int. Cl.[2] ..... B41J 1/22

[52] U.S. Cl. ..... 101/110; 101/111; 101/288

[58] Field of Search ..... 101/110, 111, 45, 85, 101/105-108, 80, 288, 290, 291

[56] References Cited

U.S. PATENT DOCUMENTS

| | | | |
|---|---|---|---|
| 660,512 | 10/1900 | Humphrey et al. | 101/80 |
| 828,478 | 2/1906 | Hodge | 101/110 X |
| 940,186 | 11/1909 | O'Heson | 101/111 |
| 1,341,021 | 5/1920 | Robbins | 101/110 |
| 1,868,997 | 7/1932 | Speicher | 101/110 |
| 3,307,672 | 3/1967 | Young | 101/110 X |
| 3,309,987 | 3/1967 | Pexton | 101/79 |
| 3,948,172 | 4/1976 | Jenkins | 101/316 |

*Primary Examiner*—Edward M. Coven
*Attorney, Agent, or Firm*—Omri M. Behr

[57] ABSTRACT

A Detent device for a key shaft of a printing mechanism, in particular for price marking apparatus, in which the printing types are settable by means of positioning wheels mounted juxtaposed rotatable about an axis, said positioning wheels having internal gearing into which pinion is capable of being engaged which is secured to the axially adjustable key shaft and in which the key shaft cooperates with a detent device which has detent recesses arranged juxtaposed in spacings corresponding to the widths of the wheels parallel to the key shaft according to the number of the positioning wheels as well as a detent resiliently engaging therein and in which on the key shaft a pointer extending over the circumference of the positioning wheels and being arranged with its point in a plane extending at a right angle to the key shaft and passing through the pinion is secured non-shiftable axially and is guided secured against rotation in the housing of the printing mechanism, characterized in that the pointer has a detent projecting at a right angle to the key shaft and arranged in a plane passing through the pinion and through the point of the pointer, said detent engaging in the detent recesses of a detent rail arranged parallel to the key shaft.

5 Claims, 5 Drawing Figures

DETENT DEVICE FOR A KEY SHAFT OF A PRINTING MECHANISM

This is a continuation, of application Ser. No. 605,783, filed Aug. 18, 1975, now abandoned.

BACKGROUND OF INVENTION (1) Field to Which Invention Relates

The present invention relates to a novel detent device for a key shaft of a printing mechanism, in particular for price marking apparatus, in which the printing types are by means of positioning wheels mounted juxtaposed rotatable about an axis, said positioning wheels having internal gearing into which a pinion is capable of being engaged which is secured to the axially adjustable key shaft and in which the key shaft cooperates with a detent device which has detent recesses arranged juxtposed in spacings corresponding to the widths of the wheels parallel to the key shaft according to the number of the positioning wheels as well as a detent resiliently engaging therein and in which on the key shaft a pointer extending over the circumference of the positioning wheels and being arranged with its point in a plane extending at a right angle to the key shaft through the pinion is secured non-shiftable axially and is guided secured against rotation in the housing of the printing mechanism.

(2) The Prior Art

A printing mechanism provided with such a detent device is known from the German Pat. application specification No. 1,561,363. In this prior art detent device the key shaft is provided with radial grooves corresponding to the number of the positioning wheels, said grooves having spacings from one another corresponding to the widths of the positioning wheels and a resilient detent engaging in said grooves, said detent being arranged stationary in the housing of the printing mechanism and being defined by a ball which is guided in a bore of the housing and is under the control of a small helical spring.

The prior art detent device has the disadvantage that the manufacture of the detent device for the axially adjustable key shaft is complicated and that the assembly thereof is rendered difficult and is time-consuming. Both the cutting of the radial grooves into the key shaft and the arrangement of a spring-biased ball in the housing of the printing mechanism are labor-intensive. Furthermore, by the arrangement of the circumferential grooves on the key shaft, the cross-section of the key shaft is weakened in such a way that it may not be made of plastic. Additionally, the detent ball would deform a key shaft made of plastic after extended use so that an exact arresting of the detent ball in the circumferential grooves would not be insured any more.

SUMMARY OF INVENTION

The objective of the invention is to avoid the described disadvantages of the prior art device and to provide a detent device for a key shaft which may be adapted to the respective widths of the printing type wheels and the type belts, resp., of the printing mechanism, without any alteration of the key shaft.

This objective is solved according to the invention in that the pointer connected to the key shaft has a detent projecting at a right angle to the axis of the positioning wheels and arranged in a plane passing through the pinion and through the point of the pointer, said detent engaging in the detent recesses of a detent rail arranged parallel to the axis.

The detent device according to the invention has the advantage that it may be adapted by a simple exchanging of the detent rail to a printing mechanism, the type belts or type wheels of which are of varying widths. For price marking apparatus, in particular for apparatus for printing, dispensing and applying self-adhesive labels, the width of the printing mechanism essentially is determined by the width of the labelling apparatus. Depending on the application purpose, however, the individual printing type wheels or the printing type belts of a printing mechanism may have different widths. In these printing mechanisms, the key shafts together with the pointer and the projecting detent may be formed completely integrally. Therefore it is only necessary to change the detent rail 26 in order to accomodate different print wheels or different print bands. This is an advantage of considerable significance and cannot be deduced from the known prior art. Since the detent is arranged at the free end of the pointer connected to the key shaft, it is able to engage in the detent recesses by the resiliency of the pointer.

For a better guiding of the pointer in the housing of the printing mechanism, it is of an advantage that the detent rail is held in engagement with the detent by resilient means. Conveniently, these resilient means are defined by a leaf spring urging the detent rail against the pointer and the detent applied to the pointer, resp., and being supported by the printing mechanism housing.

The detent rail is arranged to advantage in a channel-like recess of the housing rectangular in cross-section, said recess having a slot-like opening at one side through which the part of the pointer passes provided with the detent and guided in the channel-like recess. The detent rail may be inserted into this channel-like recess when the side wall of the printing mechanism housing is removed, and also the leaf spring or some other resilient means.

In furtherance of the invention, it is proposed that the detent rail and the resilient means be defined by a plastic part in which leafspring-like bosses are integrally formed at the side remote from the detent. This plastic part may be an injection-molded part, or it may be made in an extrusion operation.

The detent device according to the invention may be employed for printing mechanisms in which the printing types are arranged directly on the positioning wheels or in which on the other hand, flexible printing type belts are passed about the positioning wheels. In these embodiments, conveniently readout numbers are arranged also at the circumference of the printing type wheels or the type belts, said readout numbers being associated with the printing types in such a way that the point of the pointer is directed to a readout number corresponding to the printing type which is in the printing position.

In a preferred embodiment of the invention, the type wheels are set by means of positioning wheels meshing with the type wheels through the intermediary of external gearing in the tooth gaps of which readout types are arranged which correspond to the printing types of the printing type wheel respectively meshing with the positioning wheel.

LIST OF SEVERAL VIEWS OF DRAWINGS

In the following description the invention is explained in closer detail in referring to the drawings of an embodiment of the detent device according to the invention for the key shaft of a printing mechanism. Therein:

FIG. 1 is a perspective illustration of a price marking apparatus which is equipped with a printing mechanism as shown in FIGS. 2 to 4, FIG. 2 is a side elevational view of the printing mechanism with a detent device with the housing side wall removed, FIG. 3 is a plan view of the printing mechanism with the detent device for the key shaft, FIG. 4 is a perspective illustration of the key shaft with the detent device, and FIG. 5 is an enlarged illustration of the detent device shown in FIG. 2.

DESCRIPTION OF PREFERRED EMBODIMENTS

Figure 1:
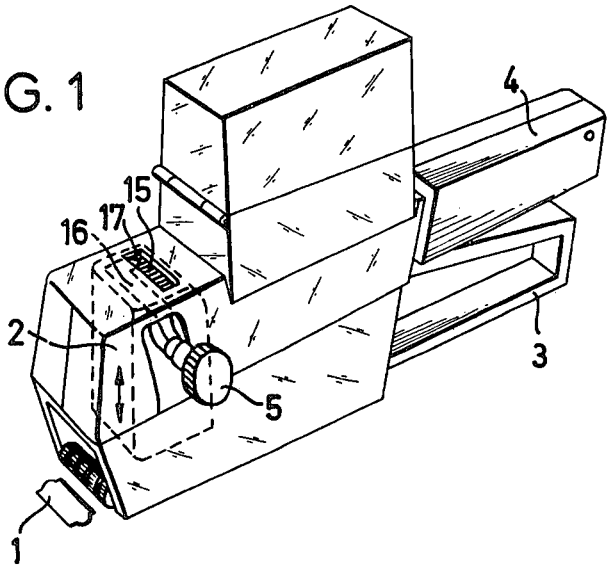
Figure 2:
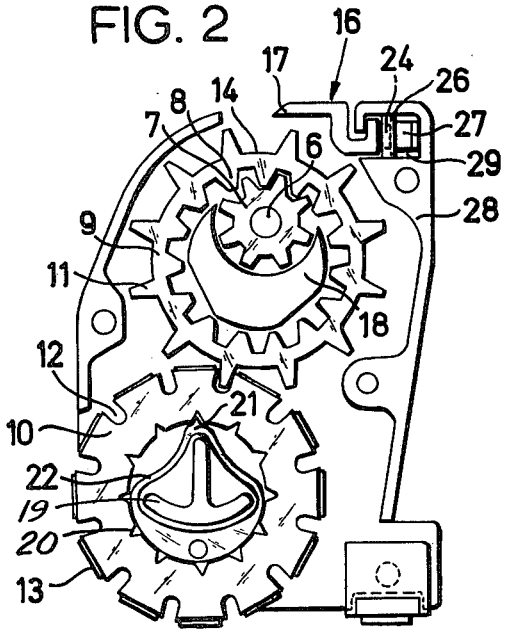
Figure 3:
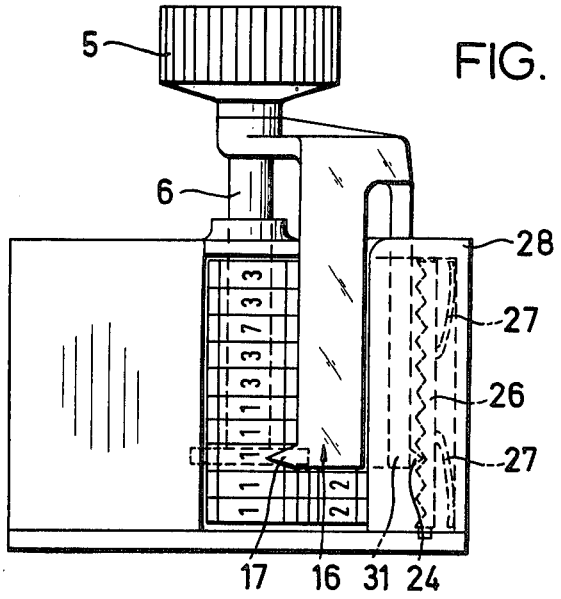

FIG. 1 shows an art apparatus for printing, dispensing and applying labels 1, which is equipped with a printing mechanism 2 which is moved toward a label disposed on the printing platen and to be printed by inwardly pivotting a hand lever 3 toward a handle 4. The elements just described are believed to be common to many prior art label printing devices. The setting of the printing mechanism 2 according to the preferred embodiment of the present invention, is effected through the intermediary of a grooved setting knob 5 of an axially adjustable key shaft 6 at the other end — as shown by FIG. 3 — of which a pinion 7 is secured which may be brought in engagement with the internal gearing 8 of positioning wheels 9 meshing with the printing type wheels 10. The teeth 11 of the positioning wheels 9 engage in recesses 12 which are arranged between the individual printing types 13 of the printing type wheels 10. At the base 14 of the tooth gaps of the positioning wheels 9 readout numbers are provided which correspond to the printing types 13 of the printing type wheels in such a way that the readout numbers are visible in a window 15 which correspond to the printing types 13 in the printing position. A pointer 16 is connected to the setting knob 5 and to the key shaft 6, resp., the point 17 of said pointer respectively pointing to that positioning wheel 9 with which the pinion 7 of the key shaft 6 is in engagement. The pointer 17 at the same time points to a readout type which corresponds to the printing type 12 respectively in the printing position. The positioning wheels 9 carrying the readout types are mounted on a shaft 18 half-moon— or crescent-like in cross-section, in the axial recess of which the key shaft 6 together with the pinion 7 is accommodated.

The printing type wheels 10 are mounted on a shaft 19 crescent-shaped in cross-section, and they have internal gearing 20 in the tooth gaps of which detents 21 engage held by resilient webs 22. The shaft 19 with the webs 22 and the detents 21 are defined by a comb-like plastic part extending over the length of the roll defined by the wheels 10. The detents 21 associated to each printing type wheel 10 and the webs 22 thereof are divided by slot-like recesses which are arranged in spacings corresponding to the widths of the wheels 10.

Figure 4:
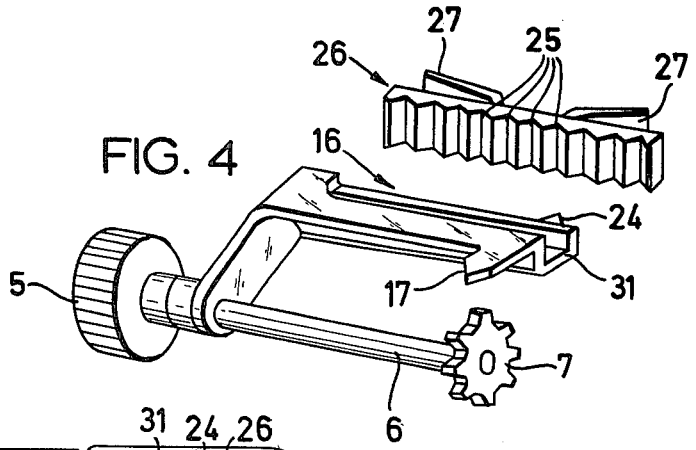
Figure 5:
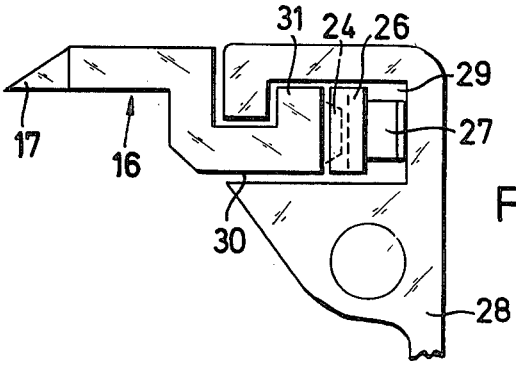

As FIGS. 3 to 5 show, a detent 24 is arranged at the pointer 16 connected to the key shaft 6, said detent projecting normal of the axis of the positioning wheels and being disposed in a plane passing through the pinion 7 and through the point 17 of the pointer 16. This detent 24 engages in detent recesses 25 worked into a detent rail 26 extending parallel to the key shaft. In the housing 28 of the printing mechanism, a recess 29 rectangular in cross-section is provided in which the detent rail is accommodated. At one side of the channel-like recess 29, a slot-like opening 30 is arranged through which the part 31 of the pointer 16 passes provided with the detent 24 and guided in the channel-like recess 29. The detent rail 26 is rectangular in cross-section and is provided with roof-like detent recesses 25 at the face directed to the detent 24, the flanks of said recesses defining an angle of more than 45° relative to one another. The projecting detent 24 likewise formed roof-like engages in these recesses 25, the flanks of said detent, however, defining a smaller angle relative to one another than the flanks of the recesses 25 do. Die tip of the detent 24 may be rounded like the tips defined by the recesses 25 may.

The detent rail 26, the pointer 16 and possibly also the key shaft 6 with the setting knob 5 and the pinion 7 are made of plastic. At the side of the detent rail 26 remote from the detent 24, leaf-spring-like bosses 27 are integrally formed which resiliently support the detent rail 26 on the housing wall 28 and which urge the face of the detent rail having the detent recesses against the projecting detent 24 and against the part 31 of the pointer 16 guided in the channel-like recess 29 of the printing mechanism housing 28.

We claim:

1. A printing apparatus for use with a price marking device, said apparatus comprising:
   - a housing;
   - a rotatable shaft extending into said housing;
   - a pinion gear attached to said rotatable shaft;
   - a plurality of read-out positioning wheels selectively engagable by said pinion gear;
   - a positioning wheel mounting shaft including an axial recess therein adapted to receive said rotatable shaft, said positioning wheels thereby surrounding said rotatable shaft and said mounting shaft;
   - a printing type means adapted to be driven by said positioning wheels, said printing type means comprising a plurality of printing type wheels having on the circumference thereof a plurality of printing type characters, said printing type wheels being directly drivable by said positioning wheels;
   - a pointer carrying means including a pointer attached to said rotatable shaft;
   - a detent attached to said pointer carrying means;
   - a detent rail including recesses therein for engaging said detent, said detent rail being located in a channel-like recess in said housing, said recess in said housing having a slot-like opening on one side thereof through which the detent of said pointer carrying means passes; and,
   - a resilient means for holding said detent rail in engagement with said detent,
   - wherein said pointer and said detent and said pinion gear all lie in substantially the same plane which is at right angles to said rotatable shaft.

2. The apparatus of claim 1 wherein said resilient means comprises a leaf spring biased against said detent rail.

3. The apparatus of claim 2 wherein said detent rail has a rectangular cross-section and wherein detent recesses have a triangular cross-section, said triangular cross-section having adjacent faces which define an angle of more than 45° relative to each other.

4. The apparatus of claim 3 wherein said detent rail and said leaf spring are defined by an integral plastic unit in which the leaf spring comprises bosses integrally formed on the side of said detent rail removed from said detent recesses.

5. The apparatus of claim 4 wherein said pointer carrying means and said pointer and said detent are all defined by one integral plastic unit having a cross-section in the form of an upwardly open U wherein one arm of said U is guided in said channel-like recess in said housing and is provided with said detent and wherein the other arm of said U comprises the pointer of said pointer carrying means.

* * * * *